US005470261A

United States Patent [19]

Embo et al.

[11] Patent Number: 5,470,261

[45] Date of Patent: Nov. 28, 1995

[54] PRESS-IN SPRING CONTACT CONNECTOR

[75] Inventors: Georges Embo, Langemark; Tom Debrouwere, Wevelgem; Werner Moyaert, Snellegem, all of Belgium

[73] Assignee: Siemens Aktiengesellschaft, Munich, Germany

[21] Appl. No.: 297,791

[22] Filed: Aug. 30, 1994

[30] Foreign Application Priority Data

Aug. 30, 1993 [DE] Germany ..... 43 29 151.1

[51] Int. Cl.[6] ..... H01R 13/436

[52] U.S. Cl. ..... 439/752; 439/686

[58] Field of Search ..... 439/686, 695, 439/701, 752, 687, 690, 696

[56] References Cited

U.S. PATENT DOCUMENTS

| | | | |
|---|---|---|---|
| 4,127,317 | 11/1978 | Tyree | 439/563 |
| 4,286,837 | 9/1981 | Yasutake et al. | 439/637 |
| 4,735,585 | 4/1988 | Palmer, III et al. | 439/752 |
| 5,190,483 | 3/1993 | Viselli | 439/752 |

FOREIGN PATENT DOCUMENTS

| | | |
|---|---|---|
| 0963345 | 10/1956 | Germany . |
| 2950097 | 3/1991 | Germany . |
| 3700304 | 8/1992 | Germany . |
| WO94/09532 | 4/1994 | WIPO . |

*Primary Examiner*—Gary F. Paumen
*Attorney, Agent, or Firm*—Hill, Steadman & Simpson

[57] ABSTRACT

A press-in spring contact connector and method of pressing the same are provided. A plurality of contact springs are clamped between inner and outer insulator members. Each contact spring has a fastening section disposed parallel to, but offset from, a press-in part. Each contact spring has a recess which is engaged by a respective nose extending from the inner insulator member, the nose extending generally perpendicularly to the fastening section. The connector can be installed using a flat die that presses against a top surface of the outer insulator member without using a traditional press-in pressure member having pressure pins. The press-in loads are transmitted through the inner insulator member, the nose members and the recesses engaged therewith, and ultimately, to the press-in parts.

19 Claims, 2 Drawing Sheets

FIG 3
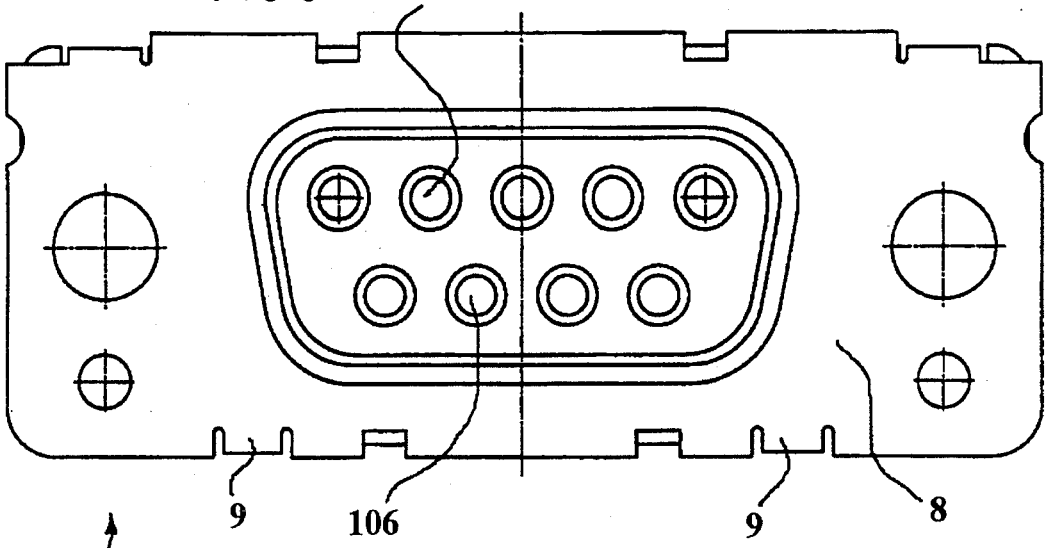
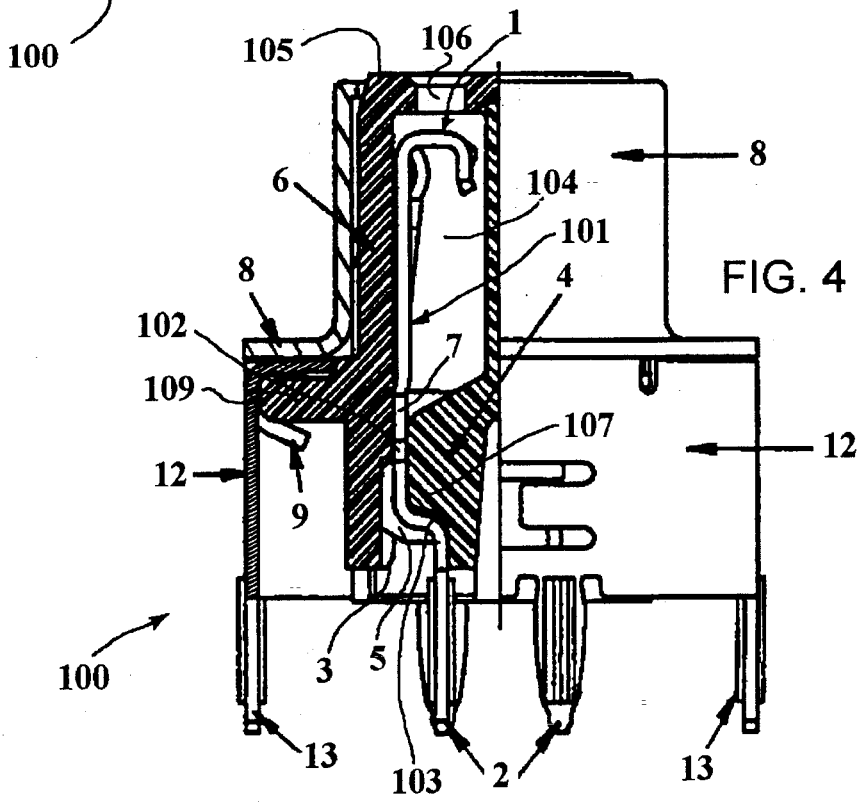
FIG. 4

PRESS-IN SPRING CONTACT CONNECTOR

BACKGROUND OF THE INVENTION

1. Field of the Invention

The invention generally relates to a press-in spring contact connector suitable for press-in installation into bores of a printed circuit board. More particularly, the present invention relates to a connector having contact springs manufactured from sheet metal wherein the contact springs are secured in an insulator in a manner that the contact springs have sufficient strength to withstand a press-in operation.

2. Description of the Prior Art

Spring contacts are known for use in solder-free press-in connectors. Generally, spring contact connectors have a plurality of contact springs secured in a plastic insulator. In known connectors, each contact spring is configured to have a press-in portion extending from the insulator, the press-in portion being configured for male insertion into contact bores of a printed circuit board. Opposite the press-in portion, known contact springs also have a contact part which is enclosed by the insulator. The contact part can be a female contact portion configured to receive a generic male connector after the spring contact connector has been installed on a printed circuit board.

For example, German Letters Patent 37 00 304, incorporated by reference herein, discloses a spring contact connector wherein a contact spring has a contact part configured as a double contact for receiving a male member into biased contact between two points. The contact spring is formed as a blade shape having a region extending downward for press-in contact. This prior art contact spring is also arranged and secured in a chamber formed between two insulator members. The contact spring has a middle region with outer edges which form a fastening section. The fastening section is clamped between the insulator members so that an interlocking occurs between shoulders extending from the outer edges and the insulator members.

Also, German application DE 92 13 611, incorporated by reference herein, discloses a press-in portion of a spring contact connector configured for optimal contact within a bore.

Traditionally, a press-in installation operation of a connector into the bores of a printed circuit board is performed by an insertion press. In prior art insertion presses, a plurality guide pins are inserted into the respective spring contacts to hold the connector. Subsequently, pressure is exerted to insert the connector into the bores. Shoulders, hooks or notches in prior art spring contacts have been provided to engage and transmit some of the press-in forces to the surrounding insulator walls. The force required to adequately press a connector into bores of a printed circuit board can be up to 120 N.

Contact springs can be damaged by the prior art press-in technique. Because press-in connectors can be small, the contact springs are rather fragile and are easily susceptible to buckling or abrasion damage. The delicate contact springs are sometimes coated with gold to provide improved contact for precision applications, such as data transmission. On the other hand, guide pins on an insertion press are usually not coated with a precious metal, as such a design would be cost prohibitive. Therefore, the mere insertion and retraction of guide pins can damage the spring contacts through abrasion.

Also, an insertion press must be constructed with a high degree of precision. If a guide pin is misaligned, insertion of the guide pin can crush a contact spring, requiring the removal of the entire connector from an assembly line.

Furthermore, a contact spring must have sufficient rigidity so that it will not deform or buckle from the loads on the press-in parts during their insertion into the bores. Therefore, the contact springs and the surrounding insulator structure are desirably complementarily designed to carry such loads using minimal material.

Spring contact connectors are available in a multitude of types having various numbers of contact springs. A corresponding insertion press must be provided which is suitable for each respective type. According to the prior art installation technique, an insertion press for use with a connector having a large number of contacts can have many guide pin components and appear something like a board of nails. In view of the necessary precision and the multitude of types required to match the various connector configurations, the insertion presses are complicated and cost-intensive tools, both for manual and automatic presses.

Therefore, a need exists for a press-in spring contact connector in which the contact springs can sufficiently carry a press-in load without deformation or buckling. A need also exists for a method of installing such a connector wherein the method minimizes a risk of damage to the spring contacts.

SUMMARY OF THE INVENTION

The object of the invention is to provide an improved press-in spring contact connector which overcomes the deficiencies of the prior art. To this end, a press-in contact connector is provided with a plurality of contact springs clamped between inner and outer insulator members. Each contact spring has a fastening section disposed parallel to, but offset from, a press-in part. Each contact spring has a recess which is engaged by a respective nose extending from the inner insulator member, the nose extending generally perpendicularly to the fastening section.

According to the present invention, such a press-in spring contact connector can be installed with a flat die that presses against a top surface of the outer insulator member without using a traditional insertion press having guide pins. The press-in power is thereby transmitted through the inner insulator member, the nose members and the recesses engaged therewith, and ultimately, to the press-in parts.

The nose members are arranged to engage the recesses closely to and in a line with the respective press-in part. This arrangement provides rigid support through the spring contact connector so that it can carry the press-in loads without bending or buckling. The press-in spring contact connector of the invention can therefore be pressed into a printed circuit board without damage to its spring contacts.

Therefore, an advantage of the present invention is to provide a spring contact connector in which neither deforming bending moments nor bucklings can occur in the spring contacts.

Another advantage of the present invention is to provide a spring contact connector which is ergonomically configured so that a press-in operation can be performed with a simple single pressure tool that eliminates a need for guide pins.

A further advantage of the present invention is to provide a press-in system and process that can be easily integrated into an automatic press-in process.

Additional features and advantages of the present invention are described in, and will be apparent from, the detailed description of the presently preferred embodiments and from the drawings.

BRIEF DESCRIPTION OF THE DRAWINGS

FIG. 3 is a top plan view of the contact part side of the embodiment of FIG. 1.

FIG. 4 is an elevated, partially sectional side view of another embodiment of a press-in spring contact connector according to the present invention.

DETAILED DESCRIPTION OF THE PRESENTLY PREFERRED EMBODIMENTS

In accordance with the invention described, with reference to the accompanying figures wherein like numerals designate like parts, a spring contact connector 100 is provided, as illustrated in FIGS. 1–4. The connector 100 is configured to be installed into bores of a printed circuit board with a solder-free, mechanically durable but releasable electrical connection. To this end, the connector 100 includes a plurality of contact springs 101. In the embodiment illustrated in FIGS. 1–4, nine contact springs 101 are arranged in two rows.

Figure 1:
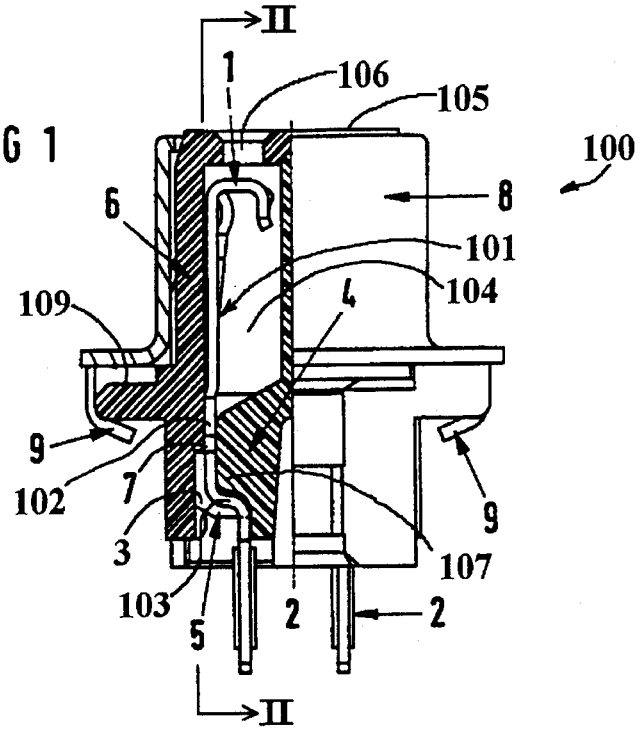
FIG. 1 is an elevated, partially sectional side view of a press-in spring contact connector according to the present invention taken generally along line I—I of FIG. 2.

As illustrated in FIG. 1, each contact spring 101 is formed of a single piece having an upper contact part 1, a lower press-in part 2, and a fastening section 102 extending generally therebetween. A lower region of the fastening section 102 serves the purpose of fastening, whereas an upper region of the fastening section 102 is configured with a pair of spring biased strips 11 leading to the contact part 1 as presented in greater detail below.

The contact part 1 is preferably configured as a double contact as disclosed by German Letters Patent 37 00 304, i.e., as a spring contact having two parallel contact locations lying opposite one another. The contact part 1 serves as a female jack for receiving pin or blade contacts of a male connector.

The connector 100 includes an inner insulator member 4 and an outer insulator member 6. The contact springs are respectively arranged in chambers 104 formed between the inner and outer insulator members 4, 6. In the two-row embodiment illustrated in FIGS. 1–4, the inner insulator member 4 is disposed centrally between the two rows of contact springs 101. The outer insulator member 6 is fitted in a sleeve-like manner over the inner insulator member 4 and the contact springs 101. Referring to FIG. 1, a top surface 105 of the outer insulator member 6 is provided with holes 106 through which the contact parts 1 of the contact springs 101 are accessible.

Figure 2:
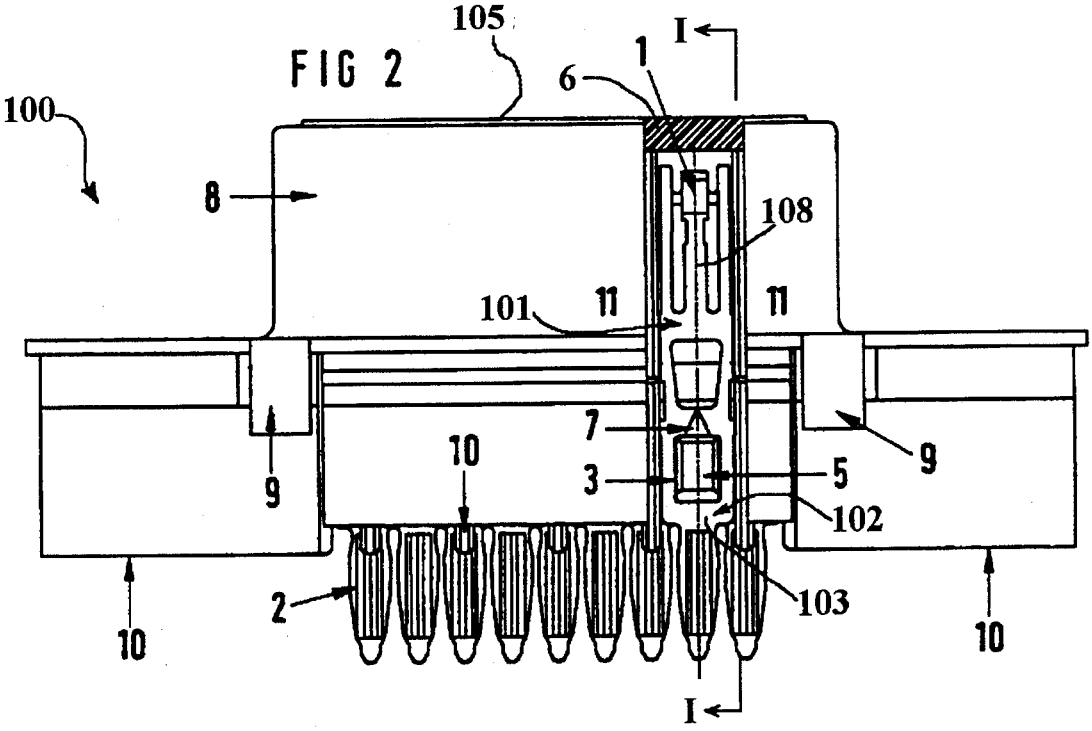
FIG. 2 is an elevated, partially sectional front view taken generally along line II—II of FIG. 1.

As illustrated in FIGS. 1, 2 and 4, each contact spring 101 is provided with a rectangular recess (aperture) 3 in a middle region of the fastening section 102. Furthermore, each contact spring 101 has a generally S-shaped crimp 103 in the fastening section 102 above the press-in part 1. The S-shaped crimp 103 forms a generally horizontal region 1. Also, a swaged region 7 is disposed at an upper side of the recess 3.

In the embodiment illustrated, the inner insulator member 4 is configured to form three walls of each chamber 104, giving the inner insulator member 4 a comb-like appearance. The chamber 104 is open toward the top and bottom and along one side prior to positioning of the outer insulator member 6. Thus, the contact springs 101 can be positioned in the chambers 104 in the inner insulator member 4 prior to positioning of the outer insulator member 6.

The inner insulator member 4 has thick portion forming a brace 107 protruding into the lower part of each chamber 104. As the contact springs 101 are positioned against the inner insulator member 4, the braces 107 retains contact springs 101 in position as the outer insulator member 6 is slipped into position, at which point the contact springs 101 are clamped between the inner insulator member 4 and the outer insulator member 6. Also, the swaged region 7 has an edge which grips the outer insulator member 6. With the outer insulator member 6 slipped on, the chambers 104 are defined in which the contact springs are respectively disposed. Preferably, the clamping between the two insulator parts 4 and 6 occurs at the swaged region 7 in the fastening section 102. In order to produce adequate creep distances, all walls of the inner insulator member 4 extend into the outer insulator member 6.

As shown in FIGS. 1 and 2, a nose member 5 extends from the brace 107 of the inner insulator member 4. The nose member 5 is configured to fit into the recess 3 of the fastening section 102. To minimize the overall dimensions of the spring contact connector 100, the S-shaped crimp 103 is provided in the fastening section. It should be understood, however, that an embodiment of the present invention could be provided with no crimps and still provide adequate strength for transmission of press-in forces.

As illustrated in FIG. 1, an air gap is located between the solid brace of the inner insulator member 4 and the horizontally extending region of the crimp 103. The gap is provided so that the transmission of forces occurs only at the interface between a lower edge of the nose member 5 and a lower edge of the recess 3. In order to avoid bending forces, the loads from a press-in installation operation result in a force transmission upwardly in-line from the press-in part 2. Therefore, the recess 3, particularly the lower edge thereof, is adequately large in order to avoid failure from pressure stresses. Also, the nose member 5 is preferably located very close to the press-in part 2. An analogous transmission of tensile forces is transmitted equally well in the reverse direction during a pulling-out of the connector 100 from the circuit board.

In order to assure a desired amount of resilient displacability of the contact part 1 transversely relative to the general orientation of the contact springs, the upper region of the fastening section is formed into a pair of parallel, narrow outer spring strips 11 with parallel inner spring strip 108 therebetween, preferably as disclosed in German Letters Patent 37 00 304. This arrangement yields a separation of functions of the contact spring 101 into an elastic, upper region and into a rigidly fixed, lower region.

In order to further reduce the risk of buckling failure of a contact spring 101 during the press-in event yet insure a good electrical contact, the press-in parts 2 are preferably configured as disclosed in German reference DE 92 136 11. Accordingly, the press-in parts 2 are configured to have a geometry so that during press-in to an associated bore, a desirable degree of deflection occurs to insure positive compliant contact with minimal insertion force.

In an embodiment where the connector 100 is used in the illustrated configuration of as a sub-miniature plug-type connector, a sheet metal housing 8 is provided over the outer insulator member 6. A plurality of clips 9 are connected to the housing 8 adjacent a ledge 109 projecting from the outer insulator member, under which the clips are bent. Thereby, the two insulator parts 4 and 6 are secured together with the housing 8.

In order to satisfy stricter shielding requirements, a metallic shielding cage 12 shown in FIG. 4 can also be provided. To that end, the cage 12 includes two symmetric sheet metal parts which are joined together by bent-over edges. The cage 12 is mounted positioned between the sheet metal housing 8 and the insulator parts 4 and 6, and the clips 9 hold these components together. The shielding cage 12 extends down to the printed circuit board. Similarly to the press-in parts 2, the cage 12 can be have pins 13 with an elastic geometry that extend downward for grounding.

Pursuant to the method of pressing in the spring contact connector 100 of the present invention, the bores in the printed circuit board are sought with the tips of the press-in parts 2. Then, a flat die presses onto the top surface 105 of the outer insulator member 6 in the direction toward the printed circuit board until spacer feet 10 contact against the printed circuit board.

Use of a flat die eliminates risk of damage to the spring contact connector 100. Furthermore, tooling changes of insertion presses individually matched to various versions of the connector 100 are not necessary, as the flat die can be used with any version of the connector having a similar top surface 105.

It should be understood that various changes and modifications to the presently preferred embodiments described herein will be apparent to those skilled in the art. For example, although the embodiment illustrated in FIGS. 1–4 includes nine spring contacts, the connector could have either more or fewer spring contacts. Such changes and modifications can be made without departing from the spirit and scope of the present invention and without diminishing its attendant advantages. It is, therefore, intended that such changes and modifications be covered by the appended claims.

What is claimed is:

1. A press-in connector configured to be mounted into bores of a printed circuit board, the connector comprising:

a plurality of contact springs, each said contact spring having a press-in part, a contact part, a fastening section, and an aperture closed on all sides thereof in the fastening section;

an inner insulator member having a plurality of nose members, the plurality of nose members corresponding to the plurality of contact springs; and an outer insulator member configured to complimentarily engage the inner insulator member so that each contact spring is respectively arranged and secured in a corresponding chamber formed between the inner and outer insulator members;

wherein each fastening section is clamped between the inner and outer insulator members so that a region of each fastening section is parallel and offset in relation to the respective press-in part, and wherein each aperture respectively receives therein the respective nose member generally perpendicularly to the fastening section.

2. The press-in connector according to claim 1, wherein the aperture is rectangular.

3. The press-in connector according to claim 1, wherein the contact springs are arranged in two rows, the inner insulator member positioned centrally between the two rows, and the outer insulator member is placed over the contact springs to engage the inner insulator member.

4. The press-in connector according to claim 1, wherein the contact springs in the contact part are configured as double contacts.

5. The press-in connector according to claim 1, wherein each fastening section has a swaged region directed toward the outer insulator member, and wherein the swaged region grips the outer insulator member.

6. The press-in connector according to claim 1, wherein each contact spring has an S-shaped crimp between the press-part and the region of the fastening section disposed parallel thereto.

7. The press-in connector according to claim 1, wherein each fastening section comprises:

an S-shaped crimped section extending from the press-in part;

a said aperture disposed in a region extending from the S-shaped crimp;

a swaged region adjacent to said aperture; and two narrow, parallel outer spring strips extending from the swaged region to the contact part.

8. The press-in connector according to claim 1, wherein each press-in part is elastic and configured to deflect when pressed into a bore.

9. The press-in connector according to claim 1, further comprising:

a sheet metal housing disposed around the outer insulator member; and at least one sheet metal clip for clamping the housing against the outer insulator member.

10. The press-in connector according to claim 9, wherein a metallic shielding cage extends downwardly to the printed circuit board from the housing.

11. A connector to be installed into a plurality of bores, the connector comprising:

an inner insulator member having a plurality of channels disposed therein, a brace being disposed at a lower region of each channel, a nose member protruding from each brace;

a plurality of spring contacts, each spring contact being disposed respectively in one of the channels, each spring contact having an upper contact part, a middle region with an aperture closed on all sides thereof, which respectively receives one of the nose members therein, and a lower press-in part configured to be respectively inserted into one of the bores; and a discrete outer insulator member disposed around the inner insulator member, the spring contacts being held between the inner and outer insulator members.

12. The connector according to claim 11, wherein each fastening section further includes a generally S-shaped portion which curves under the brace and extends to the press-in part.

13. The connector according to claim 12, wherein each press-in part is generally parallel to the respective fastening section.

14. The connector according to claim 11, wherein each fastening section also has a swaged region generally directed toward the outer insulator member for crimping the outer insulator member.

15. The connector according to claim 11, wherein the outer insulator member has a top surface disposed over a top of the inner insulator member.

16. The connector according to claim 11 further comprising a housing disposed around the outer insulator member.

17. The connector according to claim 16 further comprising a shielding cage disposed around the outer insulator member and extending downwardly from said housing toward the press-in parts.

18. The connector according to claim 11, wherein each contact spring further comprises a multiplicity of resilient spring strips extending from the fastening section to the contact part.

19. The connector according to claim 11, wherein each aperture and respectively received nosed member are generally rectangular.

* * * * *